US006344168B1

(12) United States Patent
Kuniyoshi

(10) Patent No.: US 6,344,168 B1
(45) Date of Patent: Feb. 5, 2002

(54) METHOD OF PRODUCING R-FE-B TYPE SINTERED MAGNET, METHOD OF PREPARING ALLOY POWDER MATERIAL FOR R-FE-B TYPE SINTERED MAGNET, AND METHOD OF PRESERVING THE SAME

(75) Inventor: Futoshi Kuniyoshi, Hyogo (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/649,572

(22) Filed: Aug. 29, 2000

(30) Foreign Application Priority Data

Aug. 30, 1999 (JP) ..... 11-242556

(51) Int. Cl.[7] ..... B22F 1/00; B22F 3/12

(52) U.S. Cl. ..... 419/36; 419/30; 419/38; 148/100; 148/302

(58) Field of Search ..... 419/36, 38, 30; 148/100, 302

(56) References Cited

U.S. PATENT DOCUMENTS

| | | | | |
|---|---|---|---|---|
| 4,770,723 A | | 9/1988 | Sagawa et al. | 148/302 |
| 4,792,368 A | | 12/1988 | Sagawa et al. | 148/302 |
| 5,486,224 A | * | 1/1996 | Kishimoto et al. | 75/254 |
| 5,666,635 A | | 9/1997 | Kaneko et al. | 419/12 |

FOREIGN PATENT DOCUMENTS

| | | |
|---|---|---|
| JP | 02-161701 | 6/1990 |
| JP | 06-006728 | 1/1994 |
| JP | 06-108104 | 4/1994 |
| JP | 08-191007 | 7/1996 |

OTHER PUBLICATIONS

Patent Abstracts of Japan, Partial English Translation of Laid Open unexamined Japanese Patent Publication No. 08–170103, Jul. 2, 1996, Publication Date.

Notice of Reasons of Rejection, with English translation, Mailing Date: Jan. 23, 2001, Mailing No. 012091.

Examiner's Decision of Refusal, Patent Application No. 2000–257267, Mailing Date: Aug. 30, 2001, Mailing No. 263180.

U.S. Patent Application Serial No. 09/522,472, (cited in line 23,, p. 26 of the Specification), Filing date Mar. 9, 2000.

U.S. Patent Application Serial No. 09/513,085, (cited in line 14,, p. 26 of the specification), Filing date Feb. 25, 2000.

* cited by examiner

*Primary Examiner*—Ngoclan Mai
(74) *Attorney, Agent, or Firm*—Nixon Peabody LLP; Jeffrey L. Costellia

(57) ABSTRACT

The method of producing an R—Fe—B type sintered magnet according to the present invention includes the steps of: (a) preparing an alloy powder material in a first state, in which a first amount of lubricant has been applied to a surface of an alloy powder; (b) partially evaporating said lubricant in said alloy powder material in said first state to transform said alloy powder material into a second state, in which the amount of said lubricant has been reduced to a second amount; (c) compacting said alloy powder material in said second state to form a compact; and (d) sintering said compact.

32 Claims, 4 Drawing Sheets

METHOD OF PRODUCING R-FE-B TYPE SINTERED MAGNET, METHOD OF PREPARING ALLOY POWDER MATERIAL FOR R-FE-B TYPE SINTERED MAGNET, AND METHOD OF PRESERVING THE SAME

BACKGROUND OF THE INVENTION

The present invention relates to a method of producing an R—Fe—B type sintered magnet, a method of preparing an alloy powder material for use as a raw material in the production of the R—Fe—B type sintered magnet, and a method of preserving the same.

A sintered magnet (permanent magnet) of a rare earth alloy is typically produced by compacting a powder of a rare earth alloy, sintering a compact of the powder obtained, and performing an aging heat treatment with respect to the sintered body. At present, two types of sintered magnets of rare earth alloys, which are a samarium-cobalt type magnet and a neodium-iron-boron type magnet, are used widely in different fields. Of the two types, the neodium-iron-boron type magnet (hereinafter referred to as "R—Fe—B type magnet" where R is one of rare earth elements inclusive of Y, Fe is iron, and B is boron) has been applied positively to various electronic equipment because of its highest magnetic energy product among various magnets and relatively low cost. The R—Fe—B type rare earth alloy consists of a main phase mainly composed of an $R_2Fe_{14}B$ tetragonal compound, an R-rich phase composed of Nd and the like, and a B-rich phase. It is to be noted that Fe may be partly replaced by a transition metal such as Co or Ni. As documents disclosing R—Fe—B type rare earth sintered magnets to which the present invention is applied appropriately, U.S. Pat. Nos. 4,770,723 and 4,792,368 are incorporated by reference in the present specification.

To produce a rare earth alloy forming such a magnet, there has conventionally been used ingot casting whereby a molten metal alloy as a raw material is placed in a mold and cooled relatively slowly. An alloy ingot produced by ingot casting is powdered by a well-known pulverizing process. The alloy powder thus produced is compacted by various powder pressers and transported into a sintering furnace, where it is subjected to a sintering process.

In recent years, attention has been focused on quenching methods represented by strip casting and centrifugal casting, whereby a solidified a alloy thinner than an ingot (hereinafter referred to as "an alloy flake") is formed from a molten metal alloy by bringing the molten metal alloy into contact with a single roll, double roll, a rotating disk, or an inner side of a rotating cylindrical mold and thereby performing relatively rapid quenching. The thickness of an alloy piece produced by such a quenching method is normally in the range of about 0.03 mm to about 10 mm. In accordance with a quenching method, the molten metal alloy begins to solidify from a surface thereof in contact with a cooling roll (roll contact surface and a crystal grows from the roll contact surface in the direction of thickness into a columnar configuration. As consequence, a quenched alloy produced by strip casting or the like has a structure including an $R_2Fe_{14}B$ crystal phase which has a size not less than about 0.1 $\mu$m and not more than about 100 $\mu$m in the direction of a minor axis and a size no less than about 5 $\mu$m and not more than about 500 $\mu$m in th direction of a major axis and an R-rich phase which is present dispersively in a grain boundary of the $R_2Fe_{14}B$ crystal phase. The R-rich phase is a nonmagnetic phase containing a rare earth element R at a relatively high concentration and having a thickness (corresponding to the width of the grain boundary) of about 10 $\mu$m or less.

Since a quenched alloy has been quenched in a shorter period of time (cooling rate: not less than $10^{2°}$ C./sec and not more than $10^{4°}$ C./sec) than an alloy (ingot alloy) produced by the conventional ingot casting (die casting), it features a miniaturized structure and a reduced crystal particle size. The quenched alloy also has the advantage of the R-rich phase with excellent dispersion since the grain boundary occupies a large area and the R-rich phase is spread widely in the grain boundary. These features allow a magnet having superior magnetic properties to be produced by using the quenched alloy.

In the present specification, blocks of a solidified alloy obtained by quenching or cooling a molten metal will be termed "alloy blocks" which include solidified alloys in various forms such as the alloy ingot obtained by the conventional ingot casting and the alloy flake obtained by a quenching method such as strip casting. An alloy powder subjected to compacting is obtained by grinding the alloy blocks into a coarse powder (having an average particle size of, e.g., 10 $\mu$m to 500 $\mu$m) by, e.g., hydrogenation pulverizing (i.e., hydrogenation occlusion and/or various mechanical grinding methods and then fine pulverizing the coarse powder.

However, an alloy powder produced by a quenching method, which is represented by a strip cast alloy, has the problem of susceptibility to oxidation. In general, a powder of a rare earth alloy is susceptible to oxidation and has a risk of heat generation or ignition. A powder of a quenched alloy is considered to have a particularly high risk of heat generation or ignition since the R-rich phase susceptible to oxidation easily appears on a surface of a powder particle of the quenched alloy.

To circumvent the problem, e.g., Japanese Patent Publication No. 6-6728 (Applicant: Sumitomo Special Metals Co., Ltd., Filing Date: Jul. 24, 1986) discloses a method of forming a thin oxide film on a surface of a powder of a rare earth alloy. The publication also discloses that, in order to provide superior magnetic properties, the average particle size of the powder of the rare earth alloy subjected to compacting is preferably in the range of 1.5 $\mu$m to 5 $\mu$m. If the average particle size is smaller than 1.5 $\mu$m, the proportion of the oxide becomes excessively high so that the magnetic properties are degraded. If the average particle size is larger than 5 $\mu$m, magnetization inversion easily occurs to reduce a coercive force. Japanese Patent Publication No. 6-6728 is incorporated by reference in the present specification.

To improve the compressibility (compactibility) of a powder of a rare earth metal, on the other hand, the specification of U.S. Pat. No. 5,666,635 (Assignee: Sumitomo Special Metals Co., Ltd.) discloses a technique for producing a fine powder having an average particle size of 1.5 $\mu$m to 5 $\mu$m by adding and mixing a 0.02 wt % to 5.0 wt % lubricant prepared by liquidizing at least one fatty acid ester in a coarse powder of an alloy for an R—Fe—B type sintered magnet having an average particle size of 10 $\mu$m to 500 $\mu$m and milling the mixture in a jet mill by using an inert gas. U.S. Pat. No. 5,666,635 is incorporated by reference in the present specification.

As a result of conducting a study, however, the present inventor has encountered the problem that, even if the conventional technique is used, cracks or hips assumedly resulting from poor compressibility during compacting are likely to be produced in a compact of the alloy powder. The problem was particularly notable when a rare earth alloy powder having a relatively sharp particle size distribution from which the smaller and larger particle sides of the rare earth alloy powder had been removed was used.

SUMMARY OF THE INVENTION

The present invention has been achieved to solve the foregoing problem and a primary object of the present invention is to provide a method of producing an R—Fe—B type sintered magnet and a method of preparing an alloy powder material for the R—Fe—B type sintered magnet which can reduce cracks and chips in a compact by improving the compactibility, particularly compressibility, of the alloy powder material for the R—Fe—B type sintered magnet and thereby improve productivity.

In the present specification, a powder composed only of a rare earth alloy (including an oxide film formed through the oxidation of a surface of a rare earth alloy powder) will be termed "a rare earth alloy powder" and a rare earth alloy powder having a particle surface coated with a lubricant will be termed "a rare earth metal alloy powder material". The "rare earth alloy powder material" may contain an excess of lubricant in addition to the lubricant coating the surface of the rare earth alloy powder and, if necessary, may further contain a binder.

As a result of conducting various studies in view of the foregoing problem presented by the conventional technology, the present inventor has assumed after the preparation of an alloy powder material composed of a rare earth alloy powder having a surface coated with a lubricant and before compacting, the content of the lubricant in the alloy powder material varies and the resulting variations in (and/or uniformity of) the content of the lubricant are related to the compressibility of the powder material. The variations in the content of the lubricant results in cracks or chips in a compact of the powder material.

The present inventor has further conducted a study and achieved the invention based on the finding that the compressibility can be improved and the occurrence of cracks and chips in the compact can be reduced by reducing, prior to the compacting of the alloy powder having the surface coated with the lubricant, the lubricant contained in the alloy powder material to a specified amount or less through evaporation.

A method of producing an R—Fe—B type sintered magnet according to the present invention includes the steps of: (a) preparing an alloy powder material in a first state in which a lubricant, in an amount equal to or more than a first amount, has been applied to a surface of an alloy powder for the R—Fe—B type sintered magnet; (b) partially evaporating the lubricant in the alloy powder material in the first state and thereby preparing the alloy powder material in a second state in which the amount of the lubricant has been reduced to a second amount or less; (c) compacting the alloy powder material in the second state and thereby forming a compact; and (d) sintering the compact.

In an embodiment, the step (a) may include the step of fine milling a coarse powder of the alloy while supplying the lubricant.

In another embodiment, the step (a) may include the step of mixing the alloy powder with the lubricant, while supplying the lubricant to the alloy powder prepared in advance.

Preferably, the step (b) includes the step of allowing an inert gas to flow in an airtight container containing therein the alloy powder material in the first state.

After the step (b), the method may further include the step of preserving the alloy powder material in the second state, while allowing the inert gas to flow in the container or in another airtight container.

The method may further include the step of sampling the alloy powder material in the second state reserved in the container and analyzing a composition of the sampled alloy powder material, wherein the step (c) is performed after the sampling and analyzing step.

Preferably, the alloy powder has an average particle size in the range of 3 $\mu$m to 6 $\mu$m.

The alloy powder having a specific surface area in the range of 0.45 to 0.55 $m^2/g$ when measured by the BET method an be used appropriately.

Preferably, the first amount is equal to or more than 0.15 wt % of a weight of the alloy powder.

Preferably, the second amount is equal to or less than 0.12 wt % of a weight of the alloy powder.

As the lubricant, a lubricant containing a fatty acid ester as a main component can be used.

In the step (a), the lubricant diluted with a solvent may be applied to the surface of the alloy powder. The lubricant diluted with the solvent may be supplied in the step of fine milling the coarse powder of the alloy or may be mixed in the alloy powder prepared in advance. Preferably, the total amount of the solvent and the lubricant contained in the alloy powder material in the second state is equal to or less than 0.5 wt % of a weight of the alloy powder. As the solvent, a petroleum solvent can be used. In this case also, a lubricant containing a fatty acid ester as a main component can be used as the lubricant.

In accordance with another aspect of the present invention, there is provided a method of preparing an alloy powder material for an R—Fe—B type sintered magnet, the alloy powder material being formed of an alloy powder having a surface to which a lubricant has been applied.

The method of preparing the alloy powder material according to the present invention includes the steps of: (a) preparing the alloy powder material in a first state in which the lubricant in an amount equal to or more than a first amount has been applied to a surface of the alloy powder for the R—Fe—B type sintered magnet; a (b) partially evaporating the lubricant in the alloy powder material in the first state and thereby preparing the alloy powder material in a second state in which the amount of the lubricant has been reduced to a second amount or less.

In an embodiment, the step (a) includes the step of fine milling a coarse powder of the alloy, while supplying the lubricant.

In another embodiment, the step (a) includes the step of mixing the alloy powder with the lubricant after the step of fine milling.

Preferably, the step (b) includes the step of allowing an inert gas to flow in an airtight container containing therein the alloy powder material in the first state.

Preferably, the alloy powder has an average particle size in the range of 3 $\mu$m to 6 $\mu$m.

The alloy powder having a specific surface area in the range of 0.45 to 0.55 $m^2/g$ when measured by the BET method can be used appropriately.

Preferably, the first amount is equal to or more than 0.15 wt % of a weight of the alloy powder.

Preferably, the second amount is equal to or less than 0.12 wt % of a weight of the alloy powder.

As the lubricant, a lubricant containing a fatty acid ester as a main component can be used.

In the step (a), the lubricant diluted with a solvent may be applied to the surface of the alloy powder. The lubricant diluted with the solvent may be supplied in the step of fine milling the coarse powder of the alloy or may be mixed with the alloy powder after the step of fine milling. Preferably, the total amount of the solvent and the lubricant contained in the alloy powder material in the second state is equal to or less than 0.5 wt % of a weight of the alloy powder. As the solvent, a petroleum solvent can be used. In this case also, a lubricant containing a fatty acid ester as a main component can be used as the lubricant.

In accordance with still another aspect of the present invention, there is provided a method of reserving an alloy powder material for an R—Fe—B type sintered magnet.

The method of preserving the alloy powder material according to the present invention includes the step of: preserving, in an airtight container in which an inert gas is allowed to flow, the alloy powder material composed of an alloy powder for the R—Fe—B type sintered magnet having a surface to which a lubricant in a specific amount or less has been applied.

Preferably, the alloy powder has an average particle size in the range of 3 $\mu$m to 6 $\mu$m.

The alloy powder having a specific surface area in the range of 0.45 to 0.55 $m^2/g$ when measured by the BET method can be used appropriately.

Preferably, the specified amount is equal to or less than 0.12 wt % of a weight of the alloy powder. As the lubricant, a lubricant containing a fatty acid ester as a main component can be used.

The alloy powder material may contain the lubricant and a solvent. In this case, the total amount of the lubricant and the solvent is preferably equal to or less than 0.5 wt % of a weight of the alloy powder. As the solvent, a petroleum solvent can be used. In this case also, a lubricant containing a fatty acid ester as a main component can be used as the lubricant.

DETAILED DESCRIPTION OF THE PREFERRED EMBODIMENTS

Figure 1:
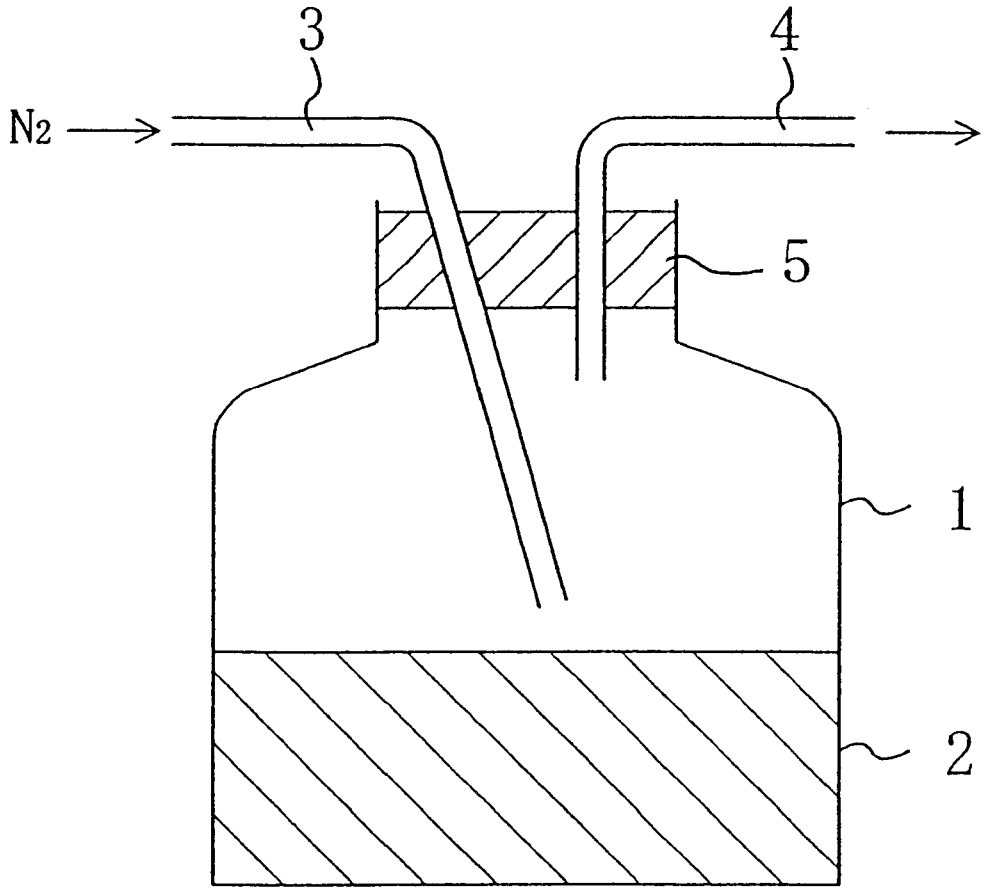
FIG. 1 is a schematic view of a container 1 for evaporating a lubricant contained in an alloy powder material by allowing a nitrogen gas to flow.

Referring now to the drawings, the embodiments of a method of producing an R—Fe—B type sintered magnet according to the present invention will be described. Although a method of preparing an alloy powder material for an R—Fe—B type magnet and a method of preserving the same according to the present invention can be implemented idependently of the other steps of the method of producing a R—Fe—B type sintered magnet, they will be described as part of the method of producing an R—Fe—B type sintered magnet for clarification.

The method of producing the R—Fe—B type sintered magnet according to the present invention includes the steps of: (a) preparing the alloy powder material in a first state in which a lubricant in an amount equal to or more than a first amount has been applied to a surface of an alloy powder for the R—Fe—B type sintered magnet; (b) partially evaporating the lubricant in the alloy powder material in the first state and thereby preparing the alloy powder material in a second state in which the amount of the lubricant has been reduced to a second amount or less; (c) compacting the alloy powder material in the second state and thereby forming a compact; and (d) sintering the compact.

Thus, the present invention provide the alloy powder material (in the second state) having the lubricant applied thereto in a required amount (equal to or less than the second amount) by preparing the alloy powder material (in the first state) having the lubricant applied thereto in an amount equal to or more than the amount (first amount) necessary to provide specified compactibility (compressibility and resistance to a chip or crack) and removing the excess lubricant through evaporation.

The present invention is based on the finding that excellent compactibility is achievable when the amount of the lubricant is equal to or less than a specified amount (second amount), which will be endorsed by specific data later. If the amount of the lubricant is excessively large compared with the specified amount, compactibility is reduced significantly. However, since the specified amount is relatively small, it is difficult to uniformly and directly apply the lubricant in the specified amount to the surface of the alloy powder. To eliminate the difficulty, the alloy powder material (in the first state) to which the lubricant has been applied in an amount equal to or more than the amount (first amount) sufficient to uniformly coat the surface of the alloy powder is prepare and the excess lubricant is removed uniformly from the alloy powder material, so that the alloy powder material in which he surface of the alloy powder is coated uniformly with the lubricant in the specified amount is provided. Since the volatility of the lubricant is uniform, the excess lubricant can be removed uniformly.

For example, the step (a) can be implemented as follows by using a known method.

First, the alloy powder subjected to compacting is obtained by preparing an alloy block in the form of an alloy ingot produced by the conventional ingot casting or in the form of an alloy flake produced by quenching method represented by strip casting, pulverizing the alloy block into a coarse powder by using, e.g., hydrogenation occlusion and/or various mechanical grinding methods (methods using such devices as a stamp mill, a jaw crusher, and a Brown mill), and fine milling the coarse powder by means of a jet mill (see U.S. Pat. No. 5,666,635). The average particle size of the coarse powder is preferably in the range of 10 $\mu$m to 500 $\mu$m. The average particle size of the alloy powder which is subjected finally to compacting is preferably in the range of about 1 $\mu$m to about 10 $\mu$m and, more preferably, in the range of about 3 $\mu$m to 6 $\mu$m. The range of the average particle size is slightly different from that (1.5 $\mu$m to 5 $\mu$m) disclosed in U.S. Pat. No. 5,666,635. However, the foregoing range was proved to be prefer in terms of compactibility and magnetic properties as a result of the study conducted by the present inventor and other joint researchers. To provide excellent compressibility, it is particularly preferred to adjust the average particle size to about 3 $\mu$m or more.

The application of the lubricant to the surface of the rare earth alloy powder may also be performed by fine milling the coarse alloy powder, while supplying the lubricant thereto. For example, as disclosed n U.S. Pat. No. 5,666,635, the application of the lubricant can be implemented by adding the lubricant to the coarse powder and then fine milling the coarse powder by means of a jet mill. Alternatively, the application of the lubricant may also be performed by spraying the lubricant into the mill while fine milling the coarse alloy powder.

Alternatively, the application of the lubricant to the surface of the rare earth alloy powder may also be performed by mixing the alloy powder prepared in advance (the aforesaid fine milled powder) with the lubricant. The method of adding and mixing the lubricant in the alloy powder having a specified average particle size (particle size distribution) that has been prepared in advance is preferred since it allows more uniform, more rapid, and more positive coating of the surface of the alloy powder with the lubricant, while eliminating the possibility that the added lubricant is partially evaporated and the entire amount of the lubricant is not mixed in the alloy powder. The lubricant may be added and mixed in the alloy powder in the collecting container of a jet mill where the alloy powder was collected or after the alloy powder was placed in another container.

The particular type of lubricant is not limited, provided that at least a part thereof evaporates. For example, a lubricant containing a fatty acid ester as a main component can be used. In particular, a lubricant which is evaporated by allowing an inert gas to flow is preferred and a liquid lubricant having volatility at a room temperature is preferred, as will be described later. Specific examples of the fatty acid ester include methyl caproate, methyl caprylate, and methyl laurate. Besides the lubricant, other compounds including a binder may also be added.

Although the lubricant may be added and mixed alone, the lubricant diluted with a solvent has the advantage of uniformly coating the surface of the alloy powder even if it is added and mixed in a relatively small amount. The lubricant diluted with a solvent also has the advantage that, even if the lubricant is in a solid state and cannot be mixed uniformly by itself in the alloy powder, it achieves uniform coating of the surface of the alloy powder. However, since it is difficult to evaporate the lubricant with the gas flow, a liquid lubricant having volatility at room temperature is used preferably. As the solvent, a petroleum solvent represented by isoparaffin and a naphthene-based solvent can be used.

The first amount of the lubricant contained in the alloy powder material in the first state obtained in the step (a) is naturally larger than the second amount of the lubricant contained in the alloy powder material in the second state which is subjected finally to compacting. The first amount is set to an amount which permits the lubricant to be applied to substantially the entire surfaces of the particles of the alloy powder in accordance with the method (surface treatment methods such as a mixing method and a milling method) used to apply the lubricant to the surface of the alloy powder. Since the lubricant has been applied in an excess amount, the amount of the lubricant on the alloy powder varies from place to place, but it is sufficient if the lubricant in a minimum required amount as been applied to substantially the entire surface. The lubricant in the minimum required amount is prevented from easily evaporating by the interaction between itself and the surface of the alloy powder (physical adsorption or chemisorption) and exists stably on the surface of the alloy powder. Therefore, once a sufficient amount of lubricant has been applied to the surface of the alloy powder, the amount of the lubricant will not be smaller than the minimum require amount in the subsequent evaporating step. As a result, alloy powder material, in which lubricant, realizing satisfactory compactability, has been added to the surface of the alloy powder, is provided.

It can be considered that the first and second amounts change appropriately depending on the type of the alloy powder (depending on, e.g., the average particle size or specific surface area). As a result of studying various alloy powders for R—Fe—B type sintered alloys (average particle size of about 2.8 to about 6.0 $\mu$m, specific surfaces areas of about 0.45 $m^2/g$ to about 0.55 $m^2/g$ measured by the BET method), it has been determined that the first amount is preferably in the range of about 0.15 wt % to about 5.0 wt % relative to the rare earth alloy powder. When expressed as a weight per unit surface area, it is preferably in the range of about 0.27 $g/m^2$ to about 0.90 $g/m^2$. If the amount of the lubricant added is smaller than about 0.15 wt %, it is difficult to uniformly coat the surface of the alloy powder with the lubricant, which may eventually reduce compactibility. When compacting is performed while a magnetic field is applied, it is also difficult to orient the individual particles of the alloy powder in the direction of the magnetic field, which may degrade the magnetic properties of a magnet obtained finally. If the amount of the lubricant added is larger than about 5.0 wt %, a long time is required to reduce the lubricant through evaporation to the second amount or less so that productivity is reduce. Preferably, the first amount is not less than about double the second amount and not more than about quadruple the second amount. As used herein the term "average particle size" means "mass median diameter (MMD)".

Step (b) can be implemented by various methods. For example, there can be listed a method of allowing an inert gas to flow in a container containing the alloy powder in the first state, a method of evacuating a container, a method of causing the alloy powder to fly in an inert as by means of a spray drier or the like, and a method of upwardly spraying an inert gas from below toward the alloy powder placed on a net. Among these, the method of allowing the inert gas to flow in the container containing the alloy powder is preferred in that the lubricant can be evaporated efficiently and the method can be implemented with a simple device. It will easily be appreciated that the container say be a container in which the lubricant was added and mixed in the alloy powder or another container in which the lubricated alloy powder was placed thereafter. In the present specification, the "inert gas" is defined to include not only an inert gas in a narrow sense (such as Ar or He) but also a nitrogen gas. Since a low-coat nitrogen gas can be use adequately, the following description will assume the inert gas to be the nitrogen gas.

For example, a gas flow can be produced in an airtight container made of stainless steel or the like by permitting a nitrogen gas to flow out of the container from an outlet, while supplying the nitrogen gas into the container from, e.g., a nitrogen bomb. By controlling the flow rate of the nitrogen gas, the evaporation speed thereof can be adjusted. The flow rate of the nitrogen gas may be determined appropriately based on the volume of the container, the amount of the alloy powder material, the amount of the lubricant to be evaporated, the speed at which the lubricant is evaporated, and the like.

The airtight container used herein indicates a container having such a degree of airtightness as to prevent air from entering the container from a port other than an inlet and the outlet for the nitrogen gas. Since a positive pressure is provided in the container due to the nitrogen gas that can be supplied from the outside, required airtightness is not so high. The use of a gas flow is also advantageous in that a container having relatively low airtightness can be used.

As a result of examining the foregoing alloy powder material, it has been determined that the amount (second amount) of the lubricant is preferably about 0.12 wt % or less relative to the alloy powder in terms of providing excellent compatibility (particularly compressibility). When expressed as a weight per unit surface area, it is preferably about 0.27 g/m$^2$ or less. In the case of diluting the lubricant with a solvent (about 4-fold to about 20-fold), the total amount of the lubricant and the solvent is preferably about 0.5 wt % or less relative to the alloy powder. When expressed on a surface area basis, the total amount is preferably about 0.90 g/m$^2$ or less.

The alloy powder material having the lubricant reduced through evaporation to the second amount or less by the gas flow in the container may also be preserved stably in the container. If the alloy powder material is preserved in a highly airtight container without gas flow therein, a phenomenon occurs in which the alloy powder absorbs oxygen in an atmosphere to provide a vacuum state in the container and further attracts the atmosphere by suction unless the airtightness is extremely high. If the alloy powder is oxidized, magnetic properties are degraded and may cause the risk of heat generation or ignition. By using the flow of the nitrogen gas, the alloy powder material can be preserved in a relatively simple container, while it is shielded from the atmosphere. Since it is unnecessary to evaporate the lubricant with the flow of the nitrogen gas, the slow rate of the nitrogen gas is adjusted appropriately to such a degree as to prevent the entrance of the atmosphere into the container.

Since the composition of the alloy powder affects magnetic properties, the composition of the alloy powder is normally analyzed for product control. Usually, the alloy powder material produced is subjected to the compacting step after the analysis of the composition of the alloy powder material is completed. Therefore, the alloy powder material which is susceptible to oxidation should be preserved stably at least during the composition analysis (typically over night). The method of controlling the amount of the lubricant by using the flow of the nitrogen gas is convenient to use since it allows as-prepared preservation of the alloy powder material. By using the gas flow, the alloy powder material can be preserved stably over two weeks or longer (in some cases, over one month or longer). If the place where the alloy powder material is produced is different from the place where the compacting and the subsequent steps are performed, the alloy powder can be transported in a stably preserved state by means of only a simple airtight container and a nitrogen bomb.

The steps (c) and (d) can be implemented by known methods. These steps can be implemented by using, e.g., the method disclosed in U.S. Pat. No. 5,666,635.

The compacting of the alloy powder material is performed by compression molding the alloy powder material under a pressure of 0.5 ton/cm$^2$ to 1.0 ton/cm$^2$ by means of an electric presser, while orienting the alloy powder material in a magnetic field of about 0.8 MA/m to 1.3 MA/m to provide a compact with a compact density of 3.9 g/cm$^3$ to 4.6 g/cm$^3$. The compact thus obtained is sintered at a temperature of, e.g., about 1000° C. to about 1180° C. for about 1 to 2 hours. By performing an aging heat treatment with respect to the sintered body at a temperature of, e.g., about 450° C. to about 800° C. for about 1 to 8 hours, an R—Fe—B type sintered magnet can be obtained. In order to reduce the amount of carbon contained in the sintered magnet and improve the magnetic property, it is preferable to burn-off (i.e., remove) the lubricant covering the surface of the alloy powder before the sintering step. The burn-off step may be carried out at a temperature of about 200° C. to 600° C. and at a pressure of about 2 Pa for about 3 to 6 hours.

In accordance with the production method of the present embodiment, cracks and ships in the compact are reduced and the productivity of the R—Fe—B type sintered magnet is improved since the alloy powder material for the R—Fe—B type sintered magnet has superior compactibility (particularly compressibility).

The following is the description of an example of the present invention.

EXAMPLE

Although the method of producing the R—Fe—B type sintered magnet according to the present invention will be described below with reference to an example, the present invention is not in the least limited to the following example.

An alloy flake containing 30 wt % Nd, 1.0 wt % B, 1.2 wt % Dy, 0.2 wt % Al, 0.9 wt % Co, the balance Fe, and unavoidable impurities was produced by strip casting described U.S. Pat. No. 5,383,978. The alloy flake was ground by hydrogenation occlusion to provide a coarse alloy powder. The coarse alloy powder was fine milled in a nitrogen gas atmosphere by means of a jet mill to provide an alloy powder having average particle size of 3.5 $\mu$m. The fine milling step was implemented appropriately by using the device and method disclosed in copending U.S. patent application Ser. No. 09/522,472, which is incorporated by reference in the present specification.

The alloy powder obtained was placed in a locking mixer. By mixing, in the alloy powder, a lubricant diluted with a mixture of methyl caproate and isoparaffin at a weight ratio of 1:9, while spraying the lubricant, an alloy powder material in which an excess of lubricant has been applied to the surface of the alloy powder (alloy powder material in the first state) was obtained. The step of mixing the lubricant in the alloy powder can be implemented appropriately by using the device and method disclosed in copending U.S. patent application Ser. No. 09/513,085, which is incorporated by reference in the present specification.

The example is further described with reference to FIG. 1. The allow powder material obtained (about 250 kg) was placed in an airtight 700-liter inner capacity container 1 made of stainless steel as shown in the schematic view of FIG 1. A nitrogen gas as an inert gas was supplied at a rate of 10 liters/min into the container 1 from a gas inlet pipe 3 fixed to a lid 5 provided removably in an upper portion of the container 1 and discharged from a gas outlet pipe 4 so that the nitrogen gas was allowed to flow relative to the alloy powder material 2 in the container 1.

Figure 2:
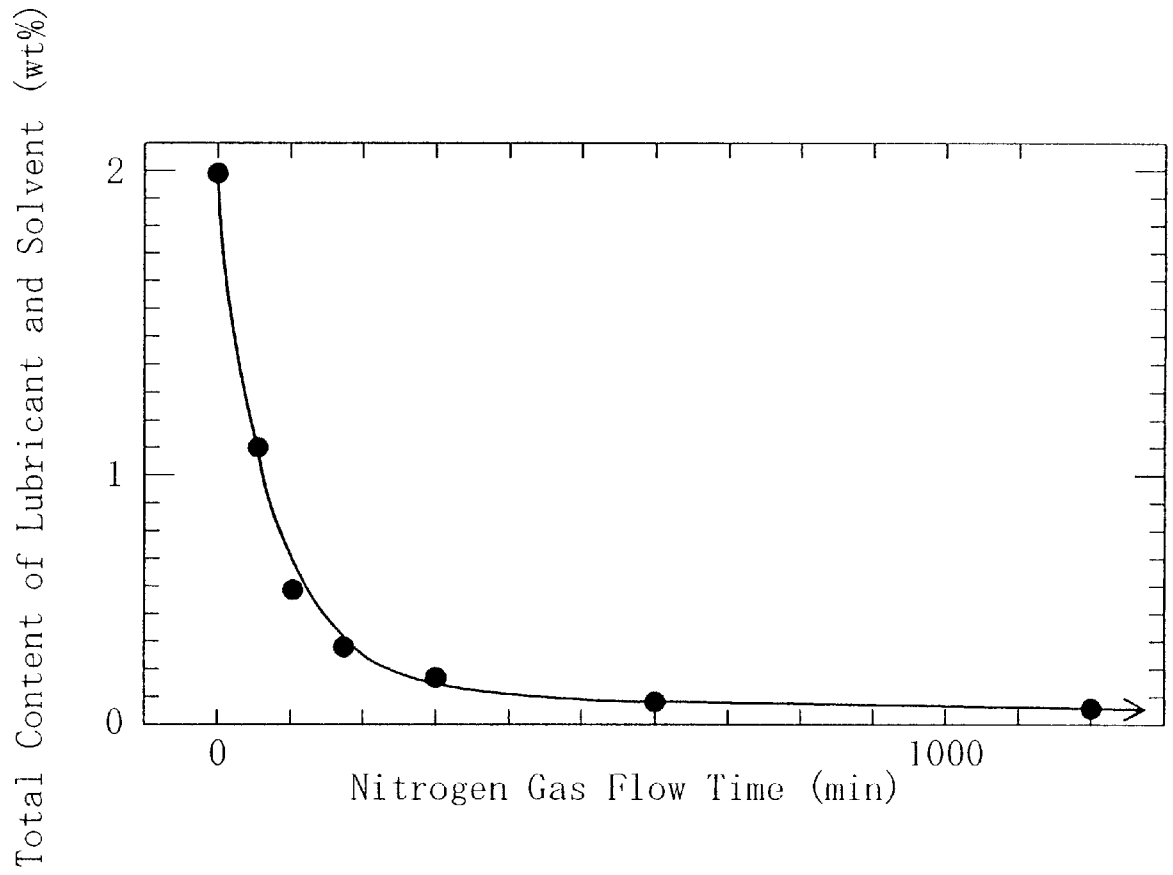
FIG. 2 is a graph showing the relationship between a nitrogen gas flow time and the total content of the lubricant and a solvent in the alloy powder material.

The relationship between the total amount of the lubricant and the solvent contained in the alloy powder material 2 (expressed as a weight percent relative to the alloy powder) and the gas flow time is shown in the graph of FIG 2.

As is obvious from FIG. 2, the content of the lubricant and the solvent decreased with the gas flow time, which indicates the evaporation of the lubricant and the solvent. Under the foregoing gas slow conditions, the amount of the lubricant and solvent which was applied at 2 wt % was reduced to 0.5 wt % after about 120 minutes and to about 0.2 wt % after about 300 minutes. Thereafter, the lubricant and the solvent were gradually evaporated for about 1,200 minutes. Once the amount of the lubricant and solvent reached about 0.06 wt %, it barely changed after about 72 hours and even after 2 weeks.

The reason that the lubricant was not evaporated after about 1200 minutes elapsed and a constant value was maintained indicates relatively strong retention of the lubricant on the surface of the powder by the interaction between the surface of the alloy powder and the lubricant. If the method of removing the lubricant applied in an excess amount to the surface of the alloy powder through evaporation is used, therefore, at least a minimum amount of lubricant is held stably on the surface of the alloy powder by the interaction between itself and the surface, so that there is no shortage of the lubricant. By utilizing the phenomenon, the alloy powder material containing the lubricant in a preferred amount can be prepared easily be removing an excess of lubricant. Moreover, since the entrance of an atmosphere into the container can be prevented by allowing the nitrogen gas to flow, the alloy powder material containing the lubricant in a preferred amount can be preserved stably over an extended period of time.

The content of the lubricant and the solvent was measured by pyrolysis gas chromatography under such conditions that the decomposition temperatures were 250° C., 500° C., and 800° C., and the column temperature was increased from 50° C. to 200° C. at a rate of 5° C./min.

Next, a description will be given to the result of evaluating the compactibility of the alloy powder material.

Figure 3:
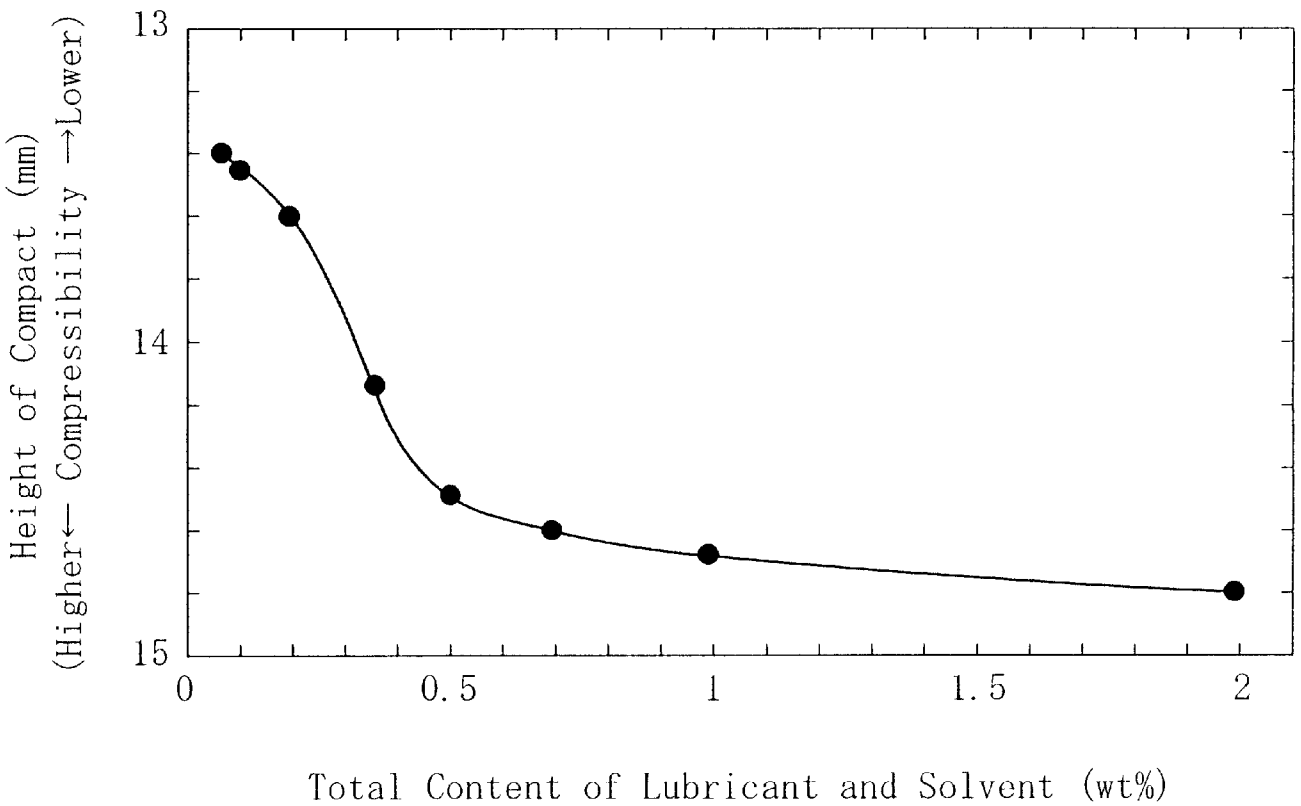
FIG. 3 is a graph showing the relationship between the total content of the lubricant and the solvent in the alloy powder material and the height of a compact obtained (compressibility)

As described above, the compactibility of the alloy powder materials containing the lubricant and the solvent in different amounts due to the evaporation of the lubricant and the solvent were evaluated. At each of the gas flow times indicated by the individual points in FIG. 2, the alloy powder material 2 was collected from the container 1 and about 7.5 g of the collected alloy powder material 2 was loaded in a cylindrical container with an inner diameter of 10 mm and press molded under about $9.8\times10^5$ Pa. FIG. 3 shows the result of examining the relationship between the total content of the lubricant and the solvent in the alloy powder material and the height of the compact obtained (in reverse correlation to compressibility).

As is obvious from FIG. 3, the height of the compact decreased and the compressibility increased as the total content of the lubricant and the solvent decreased. The compressibility improved particularly when the total content of the lubricant and the solvent was 0.5 wt % or less and the effect of improving compressibility is notable when the total content is about 0.3 wt % or less.

Figure 4:
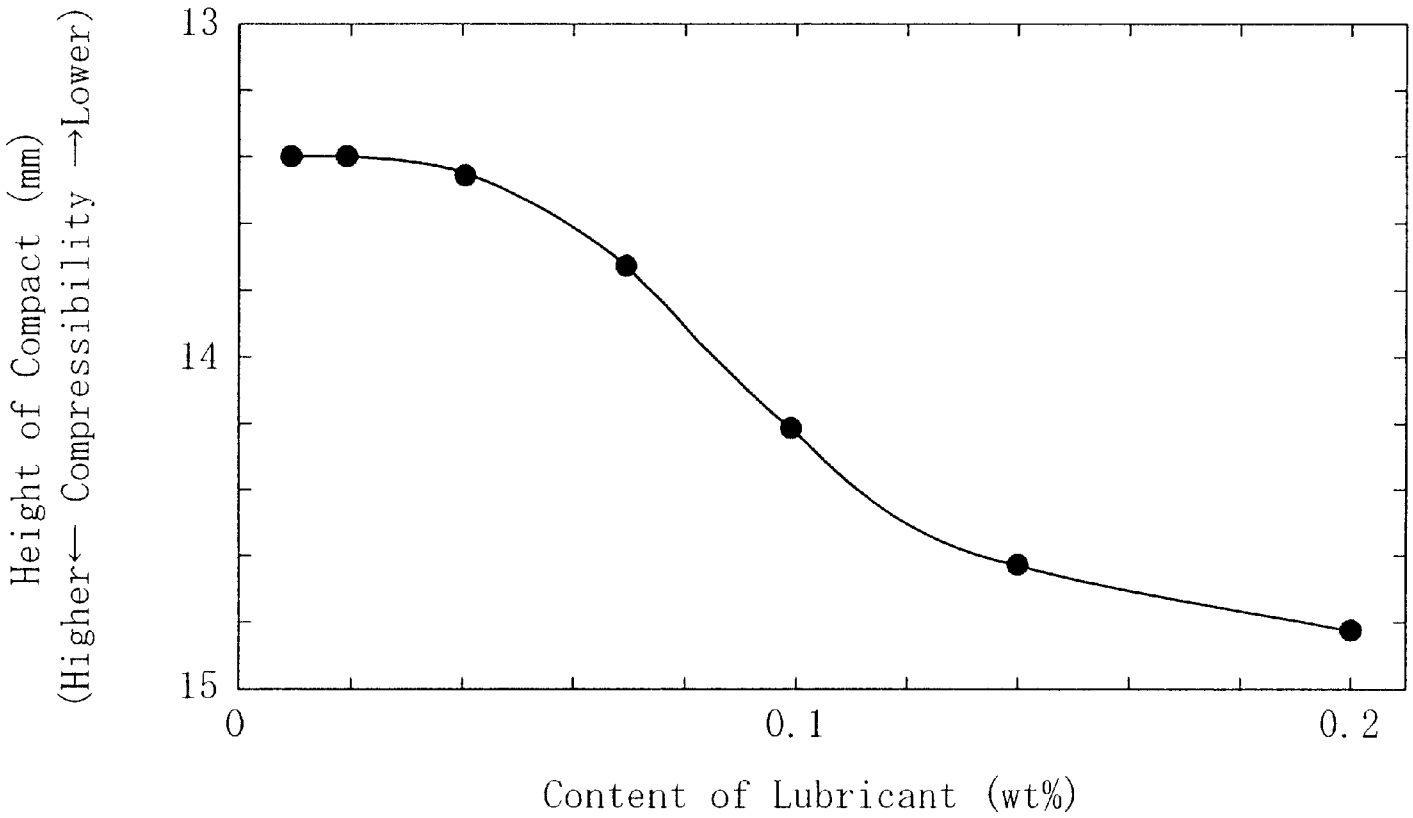
FIG. 4 is a view showing the relationship between the content of the lubricant in the alloy powder material and the height of the compact obtained (compressibility).

FIG. 4 shows the results of examining the relationship between the content of the lubricant in the alloy powder material and the height (compressibility) of the compact obtained. The result shown in FIG. 4 was obtained from the alloy powder material produced by adding only the lubricant (0.2 wt %) to the alloy powder in the same manner as described above. The individual points correspond to the different gas slow times of 0, about 60, about 120, about 180, about 300, about 600, and about 1200 minutes, similarly to FIG. 3. In the case of applying only the lubricant, the lubricant was evaporated by the flow of the nitrogen gas, similarly to the case where the lubricant was diluted with the solvent. However, the lubricant not diluted with the solvent was found to be less likely to be evaporated than the lubricant diluted with the solvent.

In this case also, it is obvious from FIG. 4 that the height of the compact decreased as the content of the lubricant decreased, which indicates improve decompressibility. The compressibility improved particularly when the content of the lubricant was about 0.12 wt % or less and the effect of improving compressibility is notable when the total content is about 0.08 wt % or less.

Chips and cracks produced during compacting in each of the alloy powder materials (about 1000 samples) used for the evaluations in FIGS. 3 and 4 were evaluated. Before the excess lubricant was removed with the flow of the nitrogen gas, ships and cracks were produced in about 100 samples. In the samples to which the lubricant diluted with the solvent was added (FIG. 3), the number of samples with chips and cracks decreased to 10 or less (fraction defective of 1% or less) when the total amount of the lubricant and the solvent was about 0.5 wt % or less and to 5 or less (fraction defective of 0.5% or less) when the total amount was about 0.3 wt % or less. In the samples in which only the lubricant was added (FIG. 4), the fraction defective when the amount of the lubricant was about 0.12 wt % was 1% or less and the fraction defective when the amount of the lubricant was about 0.08 wt % or less was 0.5% or less.

From the foregoing results, it has been shown that the compactibility of the alloy powder can be improved by evaporating the lubricant contained in the alloy powder material. This may be because the compressibility of the alloy powder material can be improved by evaporating the lubricant and thereby reducing the content thereof to a specified amount or less since the lubricant contained in an amount more than necessary in the alloy powder material exerts adverse effects mainly on the compressibility thereof.

The fact that the compressibility improves as the content of the lubricant decreases is inconsistent with the fact that cracks or chips are produced frequently if the alloy powder is compacted without adding and mixing the lubricant therein with no consideration given to the compressibility. The assumed reason is that the lubricant which is combined with (absorbed to) the alloy powder by interaction and will not dissociate therefrom is present to the surface of the alloy powder, which contributes to the improvement of the compressibility without being evaporated.

The alloy powder material 2 after the nitrogen gas was allowed flow in the container 1 for 24 hours was compacted under a pressure of 1.0 ton/cm$^2$ by means an electric presser, while it was oriented in a magnetic field of about 1.3 MA/m, to provide a compact having a compact density of about 4.3 g/cm$^3$, a width of 10 mm, a height of 10 mm, and a length of 20 mm.

The compact thus obtained was sintered in an Ar atmosphere at a temperature of, e.g., about 1080° C. for about 1 hour. By subsequently performing an aging heat treatment with respect to the sintered body at a temperature of, e.g., about 600° C. for about 1 hour, a sintered magnet was obtained.

The magnetic properties of the sintered magnet obtained were iHc (coercive force) of about 1 MA/m, Br (residual magnetic flux density) of 1.25 T, and (BH)max (maximum energy product) of about 260 kJ/m$^3$.

Thus, the present invention provides the method of preparing the alloy powder material for an R—Fe—B type sintered magnet having superior compactibility (particularly compressibility) and the method of producing the R—Fe—B type sintered magnet using the preparation method. The present invention also provides a method of stably preserving the alloy powder material for the R—Fe—B type sintered magnet having excellent compactibility (particularly compressibility). As a result, the present invention can reduce cracks and chips in the compact of the alloy powder material for the R—Fe—B type sintered magnet and thereby improve the productivity of the R—Fe—B type sintered magnet.

While the present invention has been described in a referred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

What is claimed is:

1. A method of producing an R—Fe—B type sintered magnet, said method comprising the steps of:

(a) preparing alloy powder material in a first state, in which a first amount of lubricant has been applied to a surface of an alloy powder, said first amount being equal to or more than 0.15 wt % of the weight of said alloy powder;

(b) partially evaporating said lubricant in said alloy powder material in said first state to transform said alloy powder material into a second state, in which the amount of said lubricant has been reduced to a second amount, said second amount being equal to or less than 0.12 wt % of the weight of the said alloy powder;

(c) compacting said alloy powder material in said second state to form a compact; and, (d) sintering said compact.

2. The method of claim 1, wherein said step (a) includes the steps of:

supplying a coarse alloy powder;

supplying said lubricant; and fine milling said alloy powder and said lubricant to create said alloy powder material.

3. The method of claim 1, wherein said step (a) includes the steps of:

supplying a coarse alloy powder;

fine milling said alloy powder; and supplying said lubricant to said milled alloy powder to create said alloy powder material.

4. A method of producing an R—Fe—B type sintered magnet, said method comprising the steps of:

(a) preparing alloy powder material in a first state, in which a first amount of lubricant has been applied to a surface of an alloy powder, (b) partially evaporating said lubricant in said alloy powder material in said first state to transform said alloy powder material into a second state, in which the amount of said lubricant has been reduced to a second amount;

(c) compacting said alloy powder material in said second state to form a compact; and, (d) sintering said compact, wherein the step (b) includes the step of allowing an inert gas to flow in an airtight container containing said alloy powder material in said first state.

5. The method of claim 4, further comprising, after said step (b), the step of preserving said alloy powder material in said second state while allowing said inert gas to flow in said container.

6. The method of claim 5, further comprising the steps of:

collecting a sample of said alloy powder material in said second state; and analyzing said sample for composition; wherein said step (c) is performed after said sampling and said analyzing.

7. The method of claim 1, wherein said alloy powder has an average particle size in the range of 3 $\mu$m to 6 $\mu$m.

8. The method of claim 1, wherein the specific surface area of said alloy powder measured by the BET method is in the range of 0.45 to 0.55 $m^2/g$.

9. The method of claim 1, wherein a main component of said lubricant is a fatty acid ester.

10. The method of claim 1, wherein, in said step (a), said lubricant comprises a solvent.

11. The method of claim 10, wherein the combined amount or said solvent and said lubricant contained in said alloy powder material in said second state is equal to or less than 0.5 wt % of the weight of said alloy powder.

12. The method of claim 10, wherein said solvent is a petroleum solvent.

13. The method of claim 10, wherein said lubricant comprises a fatty acid ester.

14. A method or preparing an alloy powder material for an R—Fe—B type sintering magnet, said alloy powder material composing an alloy powder having a surface to which a lubricant has been applied, said method comprising the steps of:

(a) preparing said alloy powder material in a first state, in which a first amount of said lubricant has been applied to a surface of an alloy powder, said first amount being equal to or more than 0.15 wt % of the weight of said alloy powder; and (b) evaporating a portion of said lubricant from said alloy powder to transform said alloy powder material into a second state, in which the amount of said lubricant has been reduced to a second amount, said second amount being equal to or less than 0.12 wt % of the weight of the said alloy powder.

15. The method of claim 14, wherein said step (a) includes the steps of:

supplying a coarse alloy powder;

supplying said lubricant; and fine milling said alloy powder and said lubricant to create said alloy powder material.

16. The method of claim 14, wherein said step (a) includes the steps of:

supplying a coarse alloy powder;

fine milling said alloy powder; and supplying said lubricant to said milled alloy powder to create said alloy powder material.

17. A method or preparing an alloy powder material for an R—Fe—B type sintering magnet, said alloy powder material composing an alloy powder having a surface to which a lubricant has been applied, said method comprising the steps of:

(a) preparing said alloy powder material in a first state, in which a first amount of said lubricant has been applied to a surface of an alloy powder, said first amount being equal to or more than 0.15 wt % of the weight of said alloy powder; and (b) evaporating a portion of said lubricant from said alloy powder to transform said alloy powder material into a second state, in which the amount of said lubricant has been reduced to a second amount, wherein said step (b) includes the step allowing an inert gas to flow in an airtight container containing said alloy powder material in said first state.

18. The method of claim 14, wherein said alloy powder has an average particle size in the range of 3 $\mu$m to 6 $\mu$m.

19. The method of claim 14, wherein the specific surface area of said alloy powder measured by the BET method is in the range of 0.45 to 0.55 $m^2/g$.

20. The method of claim 14, wherein said lubricant comprises a fatty acid ester.

21. The method of claim 14, wherein in said step (a), said lubricant comprise a solvent.

22. The method of claim 21, wherein the combined amount or said solvent and said lubricant contained in said alloy powder material in said second state is equal to or less than 0.5 wt % of the weight of said alloy powder.

23. The method of claim 21, wherein said solvent is a petroleum solvent.

24. The method of claim 21, wherein said lubricant comprises a fatty acid ester.

25. The method of preserving an alloy powder material for an R—Fe—B type sintered magnet, the method comprising the step: preserving, in an airtight container in which an inert gas is allowed to flow, alloy powder material comprising an alloy powder having a surface to which a lubricant in a specified amount has been applied.

26. The method of claim 25, wherein said alloy powder has an average particle size in the range of 3 $\mu$m to 6 $\mu$m.

27. The method of claim 25, wherein the specific surface area of said alloy powder measured by the BET method is in the range of 0.45 to 0.55 $m^2/g$.

28. The method of claim 25, wherein said specified amount is equal to or less than 0.12 wt % of the weight of said alloy powder.

29. The method of claim 25, wherein said lubricant comprises a fatty acid ester.

30. The method of claim 25, wherein said lubricant comprises a solvent, and the combined amount of said lubricant and said solvent is equal to or less than 0.5 wt % of the weight of said alloy powder.

31. The method of claim 30, wherein said solvent is a petroleum solvent.

32. The method of claim 30, wherein said lubricant comprises a fatty acid ester.

* * * * *